US007971625B2

(12) United States Patent
Garmyn

(10) Patent No.: US 7,971,625 B2
(45) Date of Patent: Jul. 5, 2011

(54) ANCHORING DEVICE

(75) Inventor: Tomas M. A. H. Garmyn, Willebroek (BE)

(73) Assignee: Hunter Douglas Industries BV, El Rotterdam (NL)

( * ) Notice: Subject to any disclaimer, the term of this patent is extended or adjusted under 35 U.S.C. 154(b) by 280 days.

(21) Appl. No.: 12/201,593

(22) Filed: Aug. 29, 2008

(65) Prior Publication Data

US 2009/0056269 A1 Mar. 5, 2009

(30) Foreign Application Priority Data

Sep. 3, 2007 (EP) ..... 07017189

(51) Int. Cl.
*A47H 3/00* (2006.01)

(52) U.S. Cl. ..... 160/277; 248/911; 24/135 N

(58) Field of Classification Search ..... 160/277, 160/321, 84.06, 172 R; 24/135 N, 128; 248/911, 248/913, 224.7, 257, 262, 264; 403/4; 211/119
See application file for complete search history.

(56) References Cited

U.S. PATENT DOCUMENTS

| | | | | |
|---|---|---|---|---|
| 428,783 | A * | 5/1890 | Reubel et al. | 248/262 |
| 651,637 | A * | 6/1900 | Nicol | 403/71 |
| 698,395 | A * | 4/1902 | Dudley | 5/491 |
| 953,912 | A * | 4/1910 | Laun | 248/262 |
| 1,046,728 | A * | 12/1912 | Boye | 248/262 |
| 1,169,803 | A * | 2/1916 | Greenberg | 24/115 R |
| 1,490,684 | A * | 4/1924 | Thordox | 248/262 |
| 1,807,769 | A * | 6/1931 | Wileman | 160/277 |
| 2,654,425 | A * | 10/1953 | Hayner | 160/62 |
| 3,293,711 | A * | 12/1966 | Emery, Jr. | 403/71 |
| 7,762,508 | B2 * | 7/2010 | Xu | 248/264 |
| 2009/0056269 | A1 * | 3/2009 | Garmyn | 52/705 |

FOREIGN PATENT DOCUMENTS

| | | |
|---|---|---|
| BE | 629561 | 10/1963 |
| GB | 1007045 | 10/1965 |

* cited by examiner

*Primary Examiner* — Blair M. Johnson
(74) *Attorney, Agent, or Firm* — Dorsey & Whitney LLP

(57) ABSTRACT

The invention provides an anchoring device for anchoring an elongate guide element of an architectural covering. The anchoring device includes a body having a rear surface. The body is suitable for attachment to a support structure with the rear surface in close contact with the support structure. The body includes a receiving cavity for receiving the elongate guide element, a first entrance to the receiving cavity and a second entrance to the receiving cavity. The receiving cavity can receive the elongate guide element selectively either through the first entrance, with the rear surface having a first orientation with respect to the elongate guide element, or through the second entrance, with the rear surface having a second orientation with respect to the elongate guide element, and wherein the second orientation is substantially different from the first orientation.

21 Claims, 7 Drawing Sheets

ANCHORING DEVICE

CROSS REFERENCE TO RELATED APPLICATION

This application claims priority to European Patent Application No. 07017189.7 filed on 3 Sep. 2007, and such application is hereby incorporated by reference as if fully disclosed herein.

BACKGROUND OF THE INVENTION

1. Field of the Invention

The invention relates to a device for anchoring a rigid or flexible elongate guide element, such as a guide cable or rod, of an architectural covering, such as a roller blind, a roller screen, a pleated blind, a venetian blind, or a roman shade.

2. Description of the Relevant Art

Devices for anchoring elongate guide elements of architectural coverings are known from the prior art. For example, GB1007045 discloses a securing device for a guide cable of a venetian blind that can be attached to a vertical surface, for example a surface of a wall. As a further example, BE629561 discloses a device for anchoring a guide cable of a venetian blind which can be attached to a horizontal surface, for example a surface of a window sill.

BRIEF SUMMARY OF THE INVENTION

It can sometimes be disadvantageous for a manufacturer of an architectural covering and/or for a user of an architectural covering to require different types of anchoring devices that can be used for only one of a horizontal or vertical surface. The manufacturer has to manufacture, keep in stock, package and provide different anchoring devices for each surface. The user has to select the type of anchoring device that is suitable for only one of a horizontal or vertical surface when installing the architectural covering, and may unintentionally select and mount the wrong type. In addition, the user is left with unused anchoring devices, for which he paid and which he does not use, which can be unpleasant for the user and wasteful to the manufacturer or the environment.

It is an objective of the present invention to provide an improved anchoring device that can be attached to a surface irrespective of the orientation of the surface. It is a further object of the present invention to overcome or ameliorate at least one of the disadvantages of the prior art. It is also an object of the present invention to provide alternative anchoring devices which are less cumbersome in assembly and operation and which moreover can be made relatively inexpensively. Alternatively it is an object of the invention to at least provide the public with a useful choice.

To this end, the invention provides a device for anchoring an elongate guide element of an architectural covering, the anchoring device including a body having a rear surface, a receiving cavity for receiving the elongate guide element, a first entrance to the receiving cavity in a first orientation to the rear surface and a second entrance to the receiving cavity in a second orientation to the rear surface, wherein the receiving cavity can receive the elongate guide element selectively either through one of the first entrance and the second entrance, and wherein the second orientation is substantially different from the first orientation. In this way a user can for example choose the surface of a support structure to which to anchor the anchoring device and needs only one type of anchoring device, irrespective of whether the surface is horizontal or vertical. The anchoring device can for example be attached to a substantially horizontal window sill, but also to a substantially vertical wall adjacent to the window. In both cases the same anchoring device can be used. This has the advantage that a supplier of architectural coverings can supply only one type of anchoring device, that is suitable for surfaces with various orientations. The anchoring device according to the invention can have an attractive shape and smooth surface, thus substantially preventing injury to a user of the architectural covering.

In a particular embodiment of the invention, the anchoring device according to the invention is further provided with securing means for securing the elongate guide element inside the receiving cavity, the securing means further including a holding member, the holding member being separate from the body of the anchoring device, wherein the holding member holds the elongate guide element and wherein the holding member fits inside at least part of the receiving cavity. This has the advantage that the elongate guide element can be secured to the holding member without the elongate guide element being under tension. The elongate guide element is possibly tensioned when inserting the holding member into the body of the anchoring device.

In a further particular embodiment of the invention, the first orientation is substantially perpendicular to the second orientation. Preferably, the first entrance includes a first opening and the second entrance includes a second opening, wherein the first opening is distinct from the second opening.

In a further particular embodiment, the anchoring device according to the invention further includes a first locking member that is designed to be inserted into the body of the anchoring device, the first locking member preventing escape of the holding member from the body of the anchoring device as a result of tension exerted by the elongate guide element on the holding member.

The invention also relates to a method of mounting an anchoring device for an elongate guide element according to the invention to a support structure, the anchoring device including a body, the method including: a) selecting a support structure and a surface of the support structure to which the body of the anchoring device will be attached, wherein the surface is either substantially parallel with the elongate guide element or is substantially perpendicular to the elongate guide element or makes an angle with the elongate guide element being substantially between 0 and 90 degrees, wherein the angle of the elongate guide element with respect to the surface is unimportant for the selecting; and b) attaching the body of the anchoring device to the support structure after a) has been carried out. The support structure can for example be a window sill, a window frame, or a wall. The method according to the invention has the advantage that selection criteria such as the strength of the support structure, the ease of cleaning of the mounted anchoring device, and the replacement price of the support structure can be used without having to use the orientation of the surface as a selection criterion.

The invention further provides in combination an architectural covering having an elongate guide element, an anchoring device according to the invention and discernable instructions for mounting the anchoring device in accordance with a method according to the invention.

The orientation of an anchoring device or a body of the anchoring device is defined as being taken in the direction perpendicular to its rear surface. The orientation of an elongate guide element is defined as being taken in the direction of its longitudinal extent. The orientation of a bore section is taken in the direction of its central axis of substantial symmetry.

BRIEF DESCRIPTION OF THE DRAWINGS

The invention will now be described in reference to the accompanying drawings, in which.

DESCRIPTION OF THE PREFERRED EMBODIMENTS

Figure 1:
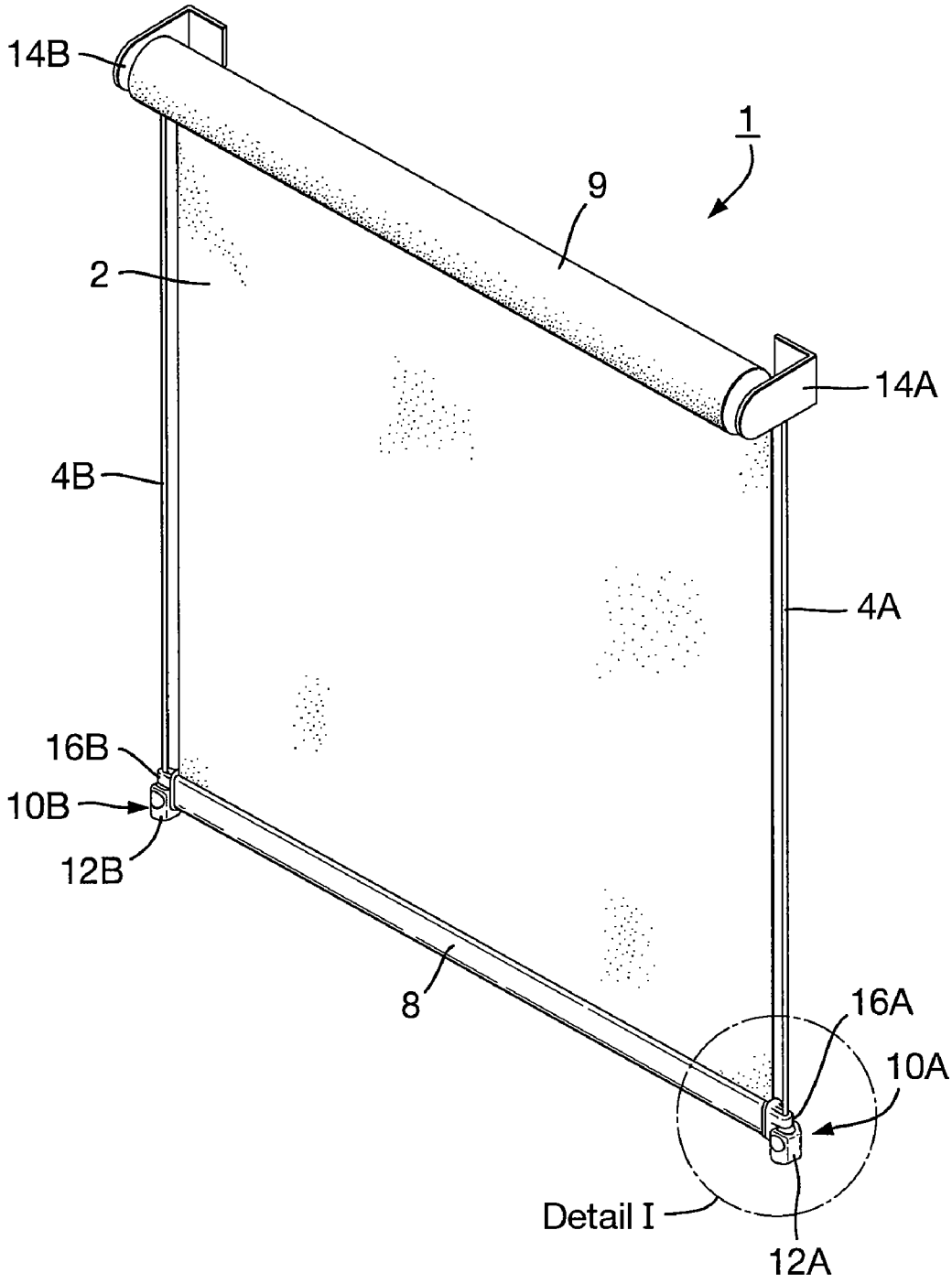
FIG. 1 shows an example of an architectural covering including an anchoring device according to the invention, suitable for covering for example a window in a wall.

FIG. 1 shows an example of an architectural covering 1, suitable for covering for example a window in a wall or a ceiling (not shown but known to the skilled person). The architectural covering includes a rollable screen 2, a right-hand guide cable 4A and a left-hand guide cable 4B that extend in the vertical direction in this example, a roller 9, a bottom bar 8, a right-hand anchoring device 10A including a right-hand body 12A and a left-hand anchoring device 10B including a left-hand body 12B. The guide cables 4A and 4B are examples of an elongate guide element. Distinct parts of the architectural covering 1 that are similar are indicated by the same number followed by a distinct index letter, such as for example the right-hand guide cable 4A and the left-hand guide cable 4B. The roller 9 is rotatably supported by a right-hand bracket 14A and a left-hand bracket 14B. The right and left bracket 14A, 14B may optionally be part of a roller mounting frame (not shown but conventional). The roller 9 is designed to roll up the rollable screen 2, and can include a spring motor or electric motor that is designed to induce the rolling up of the rollable screen 2 or alternatively to compensate the weight of the rollable screen 2 and bottom bar 8. As it is well known to those skilled in the art how such a roller 9 could be arranged and constructed, a further description is deemed superfluous. The bottom bar 8 helps in keeping the rollable screen taut and has at its opposite ends a right-hand engagement element 16A and a left-hand engagement element 16B for engaging respectively the right and the left guide cable 4A and 4B. The right and left anchoring device 10A and 10B are similar to each other and are a particular embodiment of an anchoring device according to the invention. The right and left anchoring devices 10A and 10B receive and anchor respectively the right guide cable 4A and the left guide cable 4B near a lower end of the right and left guide cable 4A and 4B. The architectural covering 1 also includes guide cable tensioning means, such as a common spring or two separate springs (not shown but conventional). Preferably, these springs are incorporated in the roller mounting frame or each of these springs is incorporated in one of the right and left bracket 14A and 14B. Preferably, each of these springs is also connected to one of the right and left guide cable 4A and 4B near an upper end of the relevant right and left guide cable 4A and 4B. As represented in FIG. 1, the springs are under tension and as a result there is tension in the right and left guide cable 4A and 4B. It will be clear to those skilled in the art how such springs can be arranged and constructed and a further description is therefore deemed superfluous. The tension in the right and left guide cable 4A and 4B prevents undue deflection of the right and left guide cable 4A and 4B in a direction perpendicular to the direction in which the guide cables extend. In FIG. 1, the right body 12A of the right anchoring device 10A and the left body 12B of the left anchoring device 10B are oriented for attachment to a substantially horizontal surface, such as a surface of a window sill. The orientation of the right and left guide cable 4A and 4B on the one hand and the orientation of the right and left body 12A and 12B on the other hand are substantially parallel to each other. The right body 12A of the right anchoring device 10A and the left body 12B of the left anchoring device 10B can for example be made of a reasonably strong and stiff material, such as wood, a plastic material or a metal, preferably aluminium or an alloy known as Zamac. The right and left guide cable 4A and 4B can for example be made of a reasonable strong material, which may be reasonable stiff, such as a steel rod, or which may be reasonably flexible, such as a polyamide, preferably Perlon, or such as a steel cable.

Figure 2:
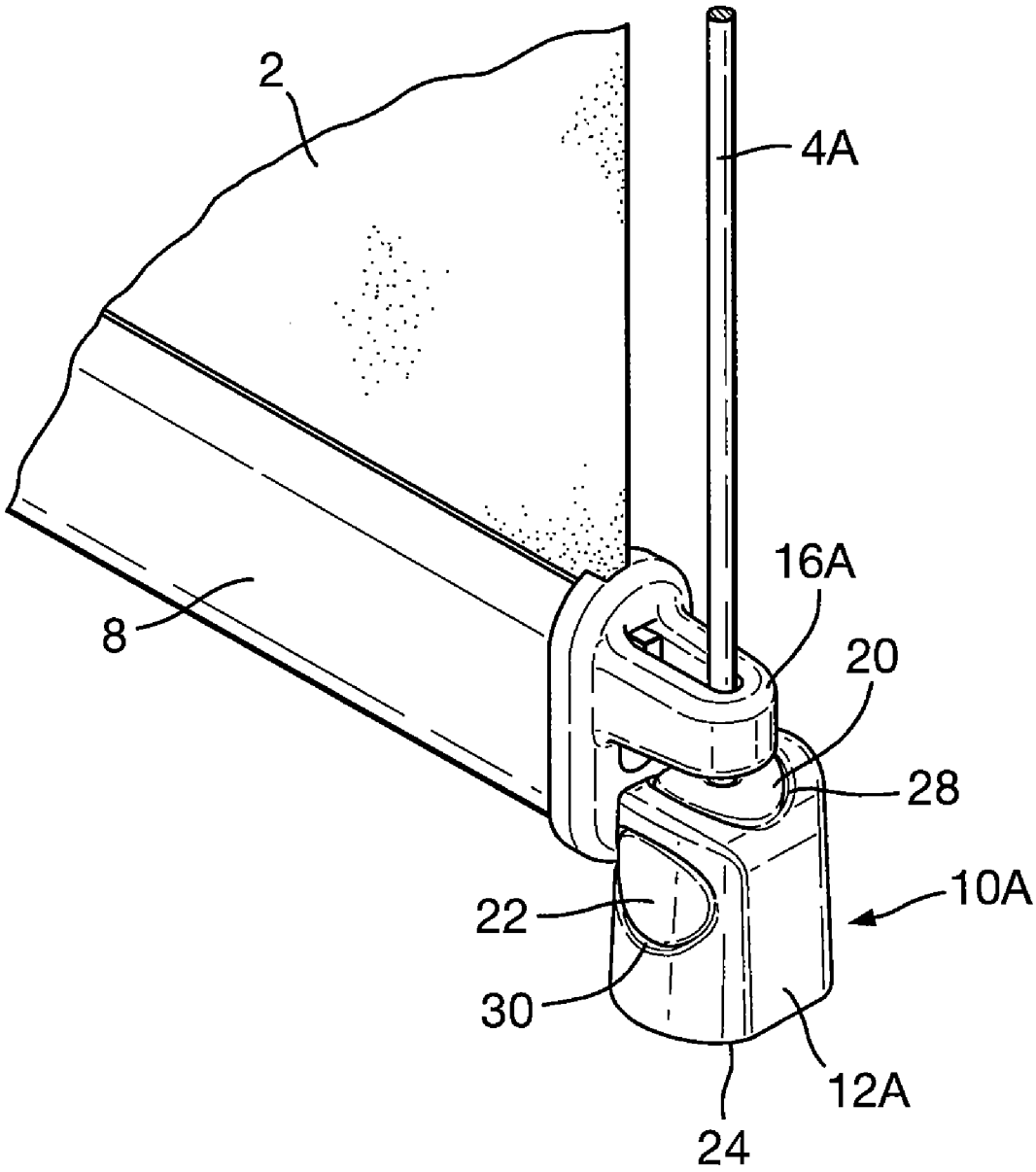
FIG. 2 is an enlargement of a detail in FIG. 1.

FIG. 2 is an enlargement of the detail I of FIG. 1. FIG. 2 shows the rollable screen 2, the right guide cable 4A, the bottom bar 8, the right engagement element 16A, and the right anchoring device 10A for mounting to a substantially horizontal surface, such as a window sill. After mounting, a rear surface 24 of the right body 12A is in close contact with the substantially horizontal surface. In the particular embodiment of an anchoring device according to the invention as shown in FIGS. 1 and 2, the right anchoring device 10A includes the right body 12A, a holding member 20, a locking member 22, and a first entrance 28 and a second entrance 30 to a receiving cavity inside the right body 12A (not shown in FIG. 2, but described further in reference to FIG. 5) that receives the right guide cable 4A. A similar arrangement applies to the left anchoring device 10B and the left body 12B of FIG. 1, which are not visible in FIG. 2. The holding member 20 holds the right guide cable 4A and is inserted into the right body 12A through the first entrance 28. The locking member 22 is inserted into the right body 12A through the second entrance 30 and prevents escape of the holding member 20 from the right body 12A, which escape could occur as a result of the tension in the right guide cable 4A. In this particular embodiment, the locking member 22 and the holding member 20 are inserted into the right body 12A in orientations that are substantially perpendicular to each other. The right anchoring device 10A and the locking of the holding member 20 by the locking member 22 will be explained in more detail in reference to FIGS. 5 and 6 herein below.

Figure 3:
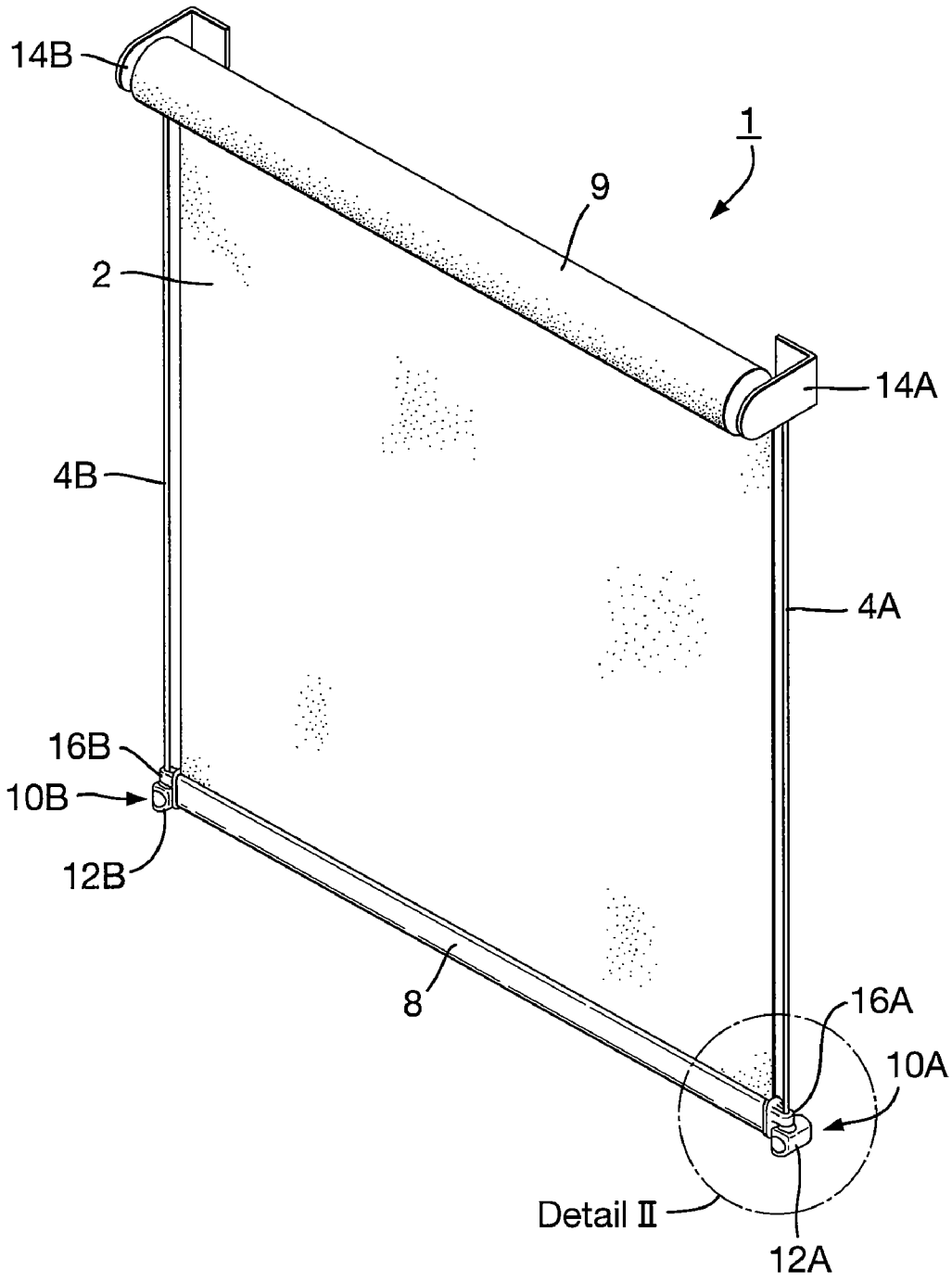
FIG. 3 shows the architectural covering of FIG. 1 with a different orientation of the anchoring devices.

FIG. 3 shows the architectural covering 1 of FIG. 1. In FIG. 3 the bodies 12A, 12B of the anchoring devices 10A, 10B have an orientation that is substantially different from the orientation of the bodies 12A, 12B in FIG. 1. In FIG. 3, the right body 12A of the right anchoring device 10A and the left body 12B of the left anchoring device 10B are oriented for attachment to a substantially vertical surface, such as a surface of a wall. The orientation of the right and left guide cable 4A and 4B on the one hand and the orientation of the right and left body 12A and 12B on the other hand are substantially perpendicular to each other.

Figure 4:
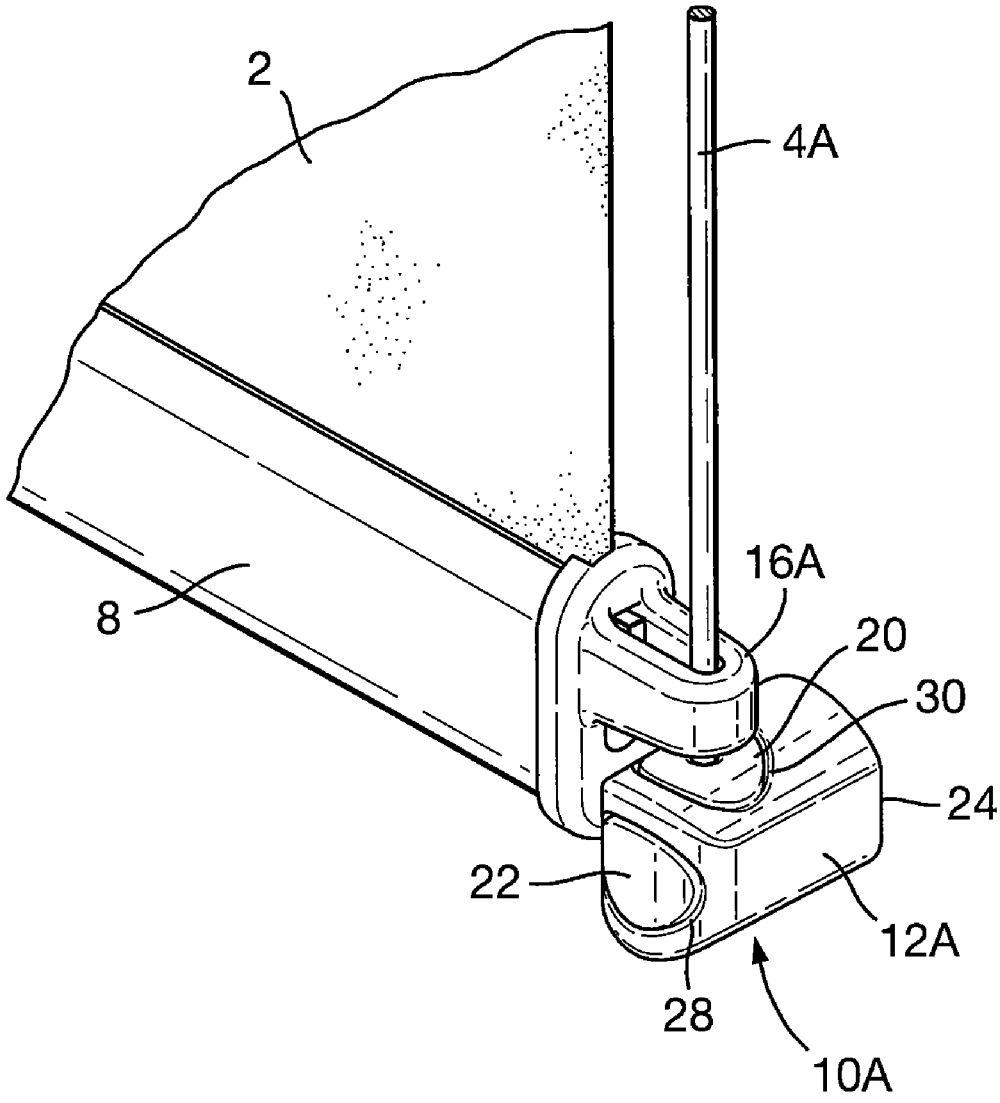
FIG. 4 is an enlargement of a detail of FIG. 3.

FIG. 4 is an enlargement of the detail 11 of FIG. 3 and shows the rollable screen 2, the right guide cable 4A, the rear surface 24 of the right body 12A, and the right anchoring device 10A in the orientation of FIG. 3 for mounting to a substantially vertical surface. The holding member 20 holds the right guide cable 4A and is inserted into the right body 12A through the second entrance 30. The locking member 22 is inserted into the right body 12A through the first entrance 28 and prevents escape of the holding member 20 from the right body 12A, which escape could occur as a result of tension in the right guide cable 4A. In this particular use of the particular embodiment of the anchoring device of FIGS. 1-4, the locking member 22 and the holding member 20 are inserted into the right body 12A in orientations that are substantially perpendicular to each other. The right anchoring device 10A and the locking of the holding member 20 by the locking member 22 in the particular embodiment of FIGS. 1-4 is further illustrated in FIGS. 5 and 6. The orientation of the right body 12A in FIG. 2 is substantially perpendicular to the orientation of the right body 12A in FIG. 4. Although the right anchoring device 10A in FIG. 4 consists of the same parts as the right anchoring device 10A in FIG. 2, this difference in orientation is achieved by reversing the first and second entrance 28 and 30 through which the locking member 22 and holding member 20 are inserted into the right body 12A. To enable this, the geometry of the second entrance 30 is similar to the geometry of the first entrance 28.

Figure 5:
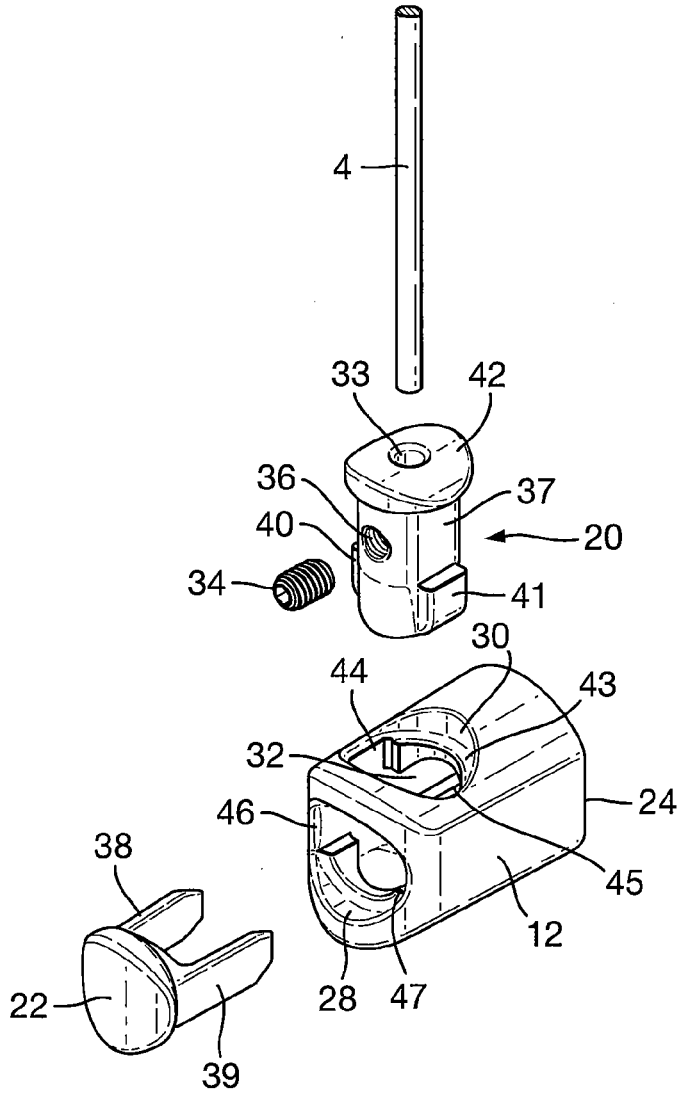
FIG. 5 shows an exploded view of the anchoring device.

FIG. 5 shows an exploded view of the right anchoring device 10A of FIGS. 1-4 in the orientation of FIGS. 3 and 4, and the right guide cable 4A. In FIGS. 5-9 and the description of these Figures, index letters and words differentiating between similar but distinct parts of the architectural covering 1 are omitted for clarity. The body 12 of the anchoring device includes the receiving cavity 32 and the rear surface 24. The body 12 can accommodate the holding member 20. The guide cable 4 can be inserted into the holding member 20 through an opening 33 in the holding member 20. A securing screw 34 can be screwed into a threaded bore 36, to secure the guide cable 4 to the holding member 20. The holding member 20 can then be inserted into the body 12 through the second entrance 30. If the anchoring device 10 is in the orientation of FIG. 1 and 2, the holding member 20 will be inserted into the body 12 through the first entrance 28. After insertion of the holding member 20 into the body 12 through the second entrance 30, the locking member 22 is inserted through the first entrance 28. The locking member 22 has a tight fit inside the receiving cavity 32 of the body 12 and tightly surrounds the holding member 20 on the surface 37 of the holding member 20 and a similar opposing surface (not shown) of the holding member 20. The first and second locking projections 38 and 39 of the locking member 22 are positioned in a tight relationship to a first projection 40 and a second projection 41 of the holding member 20, both being adjacent to an end of the holding member 20. An enlarged head portion 42, at an opposite end of the holding member 20, fits into the entrance 30. When inserted, the locking member 22 locks behind the first and second projection 40 and 41 of the holding member 20. The enlarged head portion 42 limits the depth of insertion of the holding member 20 into the entrance 30, because it engages on ridge 43. A similar ridge is present in the first entrance 28. The body 12 includes a first notch 44 and a second notch 45 that extend from the entrance 30 and continue inside the receiving cavity 32. The first and second projection 40 and 41 fit inside the first and second notch 44 and 45. In this way, rotation of the holding member 20 inside the body 12 is substantially prevented. The body 12 includes a third notch 46 and a fourth notch 47 that extend from the first entrance 28 and continue inside the receiving cavity 32. The first and second projection 38 and 39 of the locking member 22 fit inside the third and fourth notch 46 and 47. In this way, rotation of the locking member inside the body 12 is substantially prevented. The first, second, third, and fourth notch 44, 45, 46, and 47 continue so far into the cavity as to enable the complete insertion of the filling member 20 and the locking member 22. The locking member 22 can for example be made of a reasonably strong and stiff material, such as wood, a metal or a plastic material, such as a polyamide or the like. The holding member 20 can suitably be made of a reasonably strong and stiff material, such as wood, a plastic material or a metal, preferably aluminium or an alloy such as Zamac.

Figure 6:
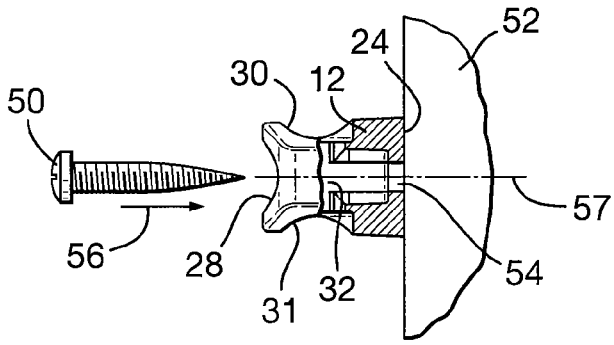
FIG. 6 shows an exploded view in cross section of the anchoring device.

FIG. 6 shows an exploded view in cross section of the body 12 of the anchoring device 10 in the orientation of FIGS. 3-5, fastening means, being in this case a screw 50, and a wall 52. The body 12 of the anchoring device 10 is provided with a fastening hole 54. The screw 50 can pass partly through the fastening hole 54 and can pass through the first entrance 28 into and past the receiving cavity 32, by moving the screw 50 in the direction of an arrow 56, so that the screw 50 can be fastened inside the wall 52 thus attaching the body 12 with its rear surface 24 to the wall 52. Preferably, the body 12 includes a third entrance 31 that is positioned opposite to the second entrance 30. In that case, the body 12 is mirror symmetric with respect to a plane indicated by the dash-dotted line 57 in FIG. 6, which plane extends perpendicular to the plane of the paper. The rear surface 24 can be substantially flat, as shown in FIG. 6. Alternatively, the rear surface 24 may have a substantially non-flat shape, and for example have the shape of a cone. The rear surface 24 can optionally include undulations at its surface, which can lead to a better attachment to the wall 52.

Figure 7:
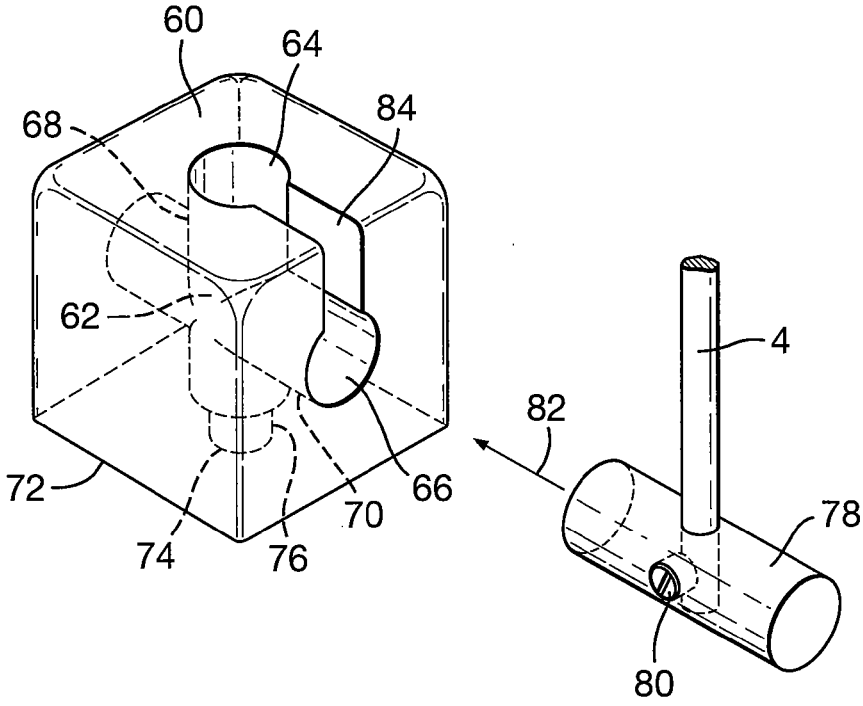
FIG. 7 shows an exploded view of an alternative embodiment of an anchoring device according to the invention.

FIG. 7 shows an exploded view of an alternative embodiment of an anchoring device according to the invention. The anchoring device of FIG. 7 can replace the anchoring device 10 in FIGS. 2 and 4. FIG. 7 shows the guide cable 4 and a body 60 having a receiving cavity 62, and having a first entrance 64 and a second entrance 66 to the receiving cavity 62. The first entrance 64 includes a first bore section 68 and the second entrance 66 includes a second bore section 70, which are oriented substantially perpendicular to each other. The anchoring device of FIG. 7 has a rear surface 72 having a fastening structure including a fastening hole 74 and a restriction 76, so that the body 60 can be fastened to for example a window sill. FIG. 7 also shows a holding member 78 that includes a securing screw 80, which holds the guide cable 4 secured to the holding member 78. The holding member 78 can be inserted into the body 60 of the anchoring device of FIG. 7 by moving the holding member 78 in the direction of an arrow 82. The guide cable 4 can pass through a passage 84. When the guide cable 4 is under tension, it will need an extra lateral force to enforce escape of the holding member 78 from the body 60, which lateral force is not exerted during normal operation of the architectural covering. The particular embodiment of FIG. 7 has the additional advantage that the holding member 78 will easily escape from the body 60 when for example a child is caught with its head between the guide cable 4 under tension and the window, as the child will probably exert the lateral force when struggling to get free. The shape of the passage 84 is not limited to the shape shown in FIG. 7, but can have another shape as well. It can for example pass adjacent to a corner of the body 60 or can have a curved shape. The shape of the passage 84 can be designed in order to find an optimum balance between ease of escape as result of a lateral force and reliability of the anchoring during normal operation. Clearly, the passage 84 may alternatively be designed to minimize ease of escape for situations where child hazards are not an issue. The body 60 may include an additional passage (not shown). The corners of the body 60 that do not touch a surface to which the body 60 is attached, can be radiused in order to prevent accidental injury to the child or to a user of the architectural covering.

Figure 8:
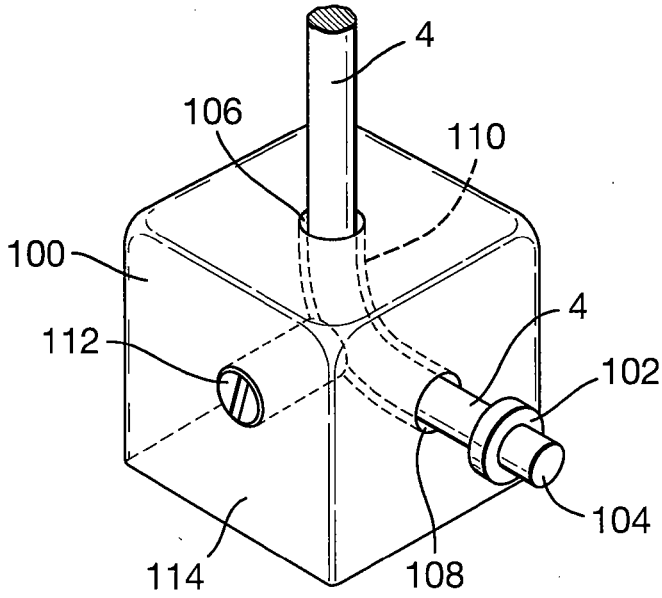
FIG. 8 shows a schematic view of another embodiment of an anchoring device according to the invention.
Figure 9A:
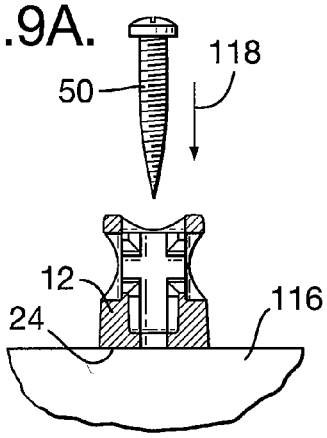
FIG. 9A-E shows successive steps of a preferred method of mounting an anchoring device according to the invention.
Figure 9B:
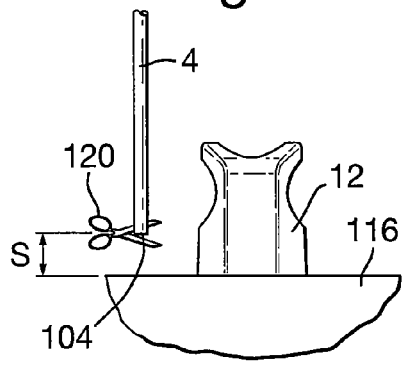
Figure 9C:
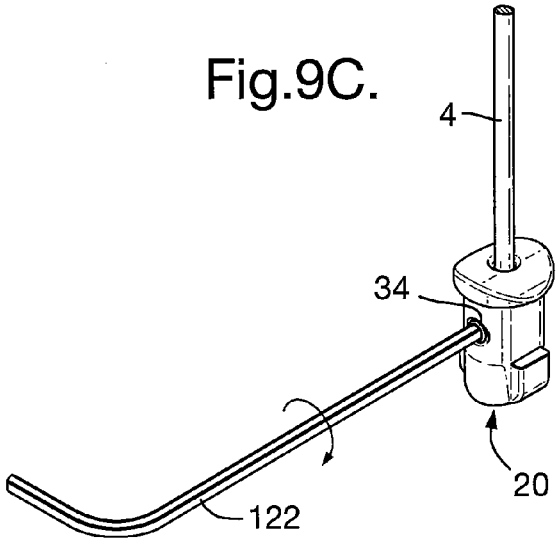
Figure 9D:
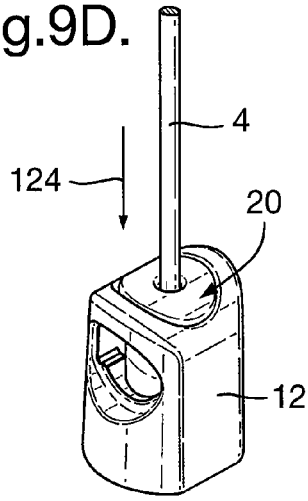
Figure 9E:
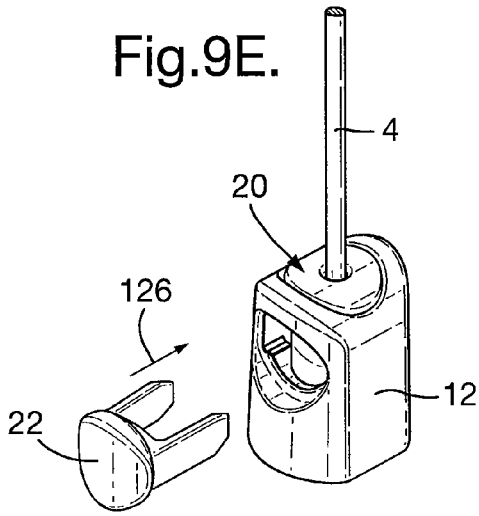

FIG. 8 shows a schematic view of another embodiment of an anchoring device according to the invention. The anchoring device of FIG. 8 can alternatively replace the anchoring device 10 in FIG. 1. FIG. 7 shows the guide cable 4, a body 100 and a stop member, being a collar 102 in the embodiment of FIG. 8. The collar 102 can for example be secured to the guide cable 4 by deforming the collar 102 using a pair of pliers. The collar 102 is secured around the guide cable 4, near a guide cable end 104 after the guide cable end 104 has passed through the body 100. Alternatively, the collar 102 may be replaced by a knot in the cable 4 near the cable end 104. The body 100 includes a first entrance 106 and a second entrance 108. The first entrance 106 is connected with the second entrance 108 by a cable duct 110. The cable duct 110 includes a first bore section, a receiving cavity, and a second bore section. The cable duct 110 can accommodate the guide cable 4. The anchoring device includes a screw 112 for securing the guide cable 4 in the cable duct 110. The rear surface 114 of the device can be attached to a surface of a support structure, for example a wall, a window sill, or a window frame. In the example of FIG. 8, the cable end 104 is inserted into the body 100 through the first entrance 106 and the cable end 104 exits the body 100 through the second entrance 108. In this case, the rear surface 114 can be attached to a substantially horizontal surface, such as a surface of a window sill, when the cable 4 is oriented substantially vertically. When the cable end 104 is inserted into the second entrance 108 and the cable end 104 exits the body 100 through the first entrance 106, the rear surface 114 can be attached to a substantially vertical surface, such as a surface of a wall, when the guide cable 4 is substantially vertical. Attaching the body 100 to a surface can for example be done by using glue or by using a screw (not shown) that partly passes through a hole (not shown) leaving the body 100 through the rear surface 114. The cross section of the first entrance 106 and the second entrance 108 and possibly also part of the cross section of the cable duct 110 may be locally widened adjacent to a surface of the body 100 so that the collar 102 and the cable end 104 are accommodated by the body 100 and do not project outside the body 100.

FIGS. 9A-E show successive steps of a preferred method of mounting an anchoring device according to the invention. In the preferred method, the anchoring device is the anchoring device 10 of FIGS. 2 and 4, in an orientation according to FIG. 2. In a first step of the preferred method, a support structure and a surface thereon are selected for attachment of the body 12 of the device 10 thereto. The selection process can preferably include considering the strength of the support structure, because the support structure will not be able to resist the tension exerted by the guide cable if the support structure is relatively weak. In addition, the selection process can preferably include considering the ease of cleaning of the anchoring device and the support structure adjacent to the anchoring device. In addition, the selection process can preferably include considering the replacement price of the support structure, because the attachment process can damage the support structure, and there could be a need to replace the support structure in case the architectural covering is removed. In selecting the surface, the surface can be either substantially parallel or substantially perpendicular to the orientation of the guide cable 4. The guide cable 4 can also make an angle substantially between 0 and 90 degrees with the surface. In this case, the guide cable 4 leaves the holding member 20 under an angle. For illustrating next steps of the preferred method, we choose to attach the anchoring device to a substantially horizontal surface, such as a surface of a window sill. The guide cable 4 is oriented substantially vertically. In a next step of the preferred method, depicted in FIG. 9A, the body 12 of the anchoring device 10 is with its rear surface 24 attached to the window sill 116, in this example by using the screw 50. The screw 50 is moved in the direction of an arrow 118, so that the screw 50 can be fastened inside the window sill 116 thus attaching the body 12 to the window sill 116. In a next step of the preferred method, depicted in FIG. 9B, the length of the guide cable 4 is adjusted. In this example, the guide cable 4 is shortened to a length such that there is a distance S between the end of the guide cable 104 and the window sill 116, with the distance S being between predetermined boundaries. These boundaries depend on a choice of the stiffness of the spring that exerts tension on the cable 4 and the length of the guide cable 4. Preferably, the distance S is such that the end of the guide cable 104 substantially coincides with the top of the body 12. This brings about ease of mounting of the anchoring device 10. It is for example possible to use a pair of scissors 120 for adjusting the length of the cable 4. In a next step of the preferred method, depicted in FIG. 9C, the guide cable 4 is secured inside the holding member 20 by fastening the securing screw 34, in this example this is done by using an Allan key 122. According to a next step of the preferred method, depicted in FIG. 9D, after having secured the guide cable 4 inside the holding member 20, the holding member 20 is inserted into the body 12 by moving the holding member 20 in a direction substantially parallel with an arrow 124. After this step, the guide cable 4 has a tension that is within predetermined boundaries. In a next step of the preferred method, depicted in FIG. 9E, the locking member 22 is inserted into the body 12, by moving the locking member 22 in a direction substantially parallel with an arrow 126.

It is thus believed that the operation and construction of the present invention will be apparent from the foregoing description. The invention is not limited to any embodiment herein described and, within the purview of the skilled person, modifications are possible which should be considered within the scope of the appended claims. Equally all kinematic inversions are considered inherently disclosed and to be within the scope of the present invention. The term comprising when used in this description or the appended claims should not be construed in an exclusive or exhaustive sense but rather in an inclusive sense. Expressions such as: "means for . . . " should be read as: "component configured for . . . " or "member constructed to . . . " and should be construed to include equivalents for the structures disclosed. The use of expressions like: "critical", "preferred", "especially preferred" etc. is not intended to limit the invention. Features which are not specifically or explicitly described or claimed may be additionally included in the structure according to the present invention without deviating from its scope.

The invention claimed is:

1. Anchoring device for anchoring an elongate guide element of an architectural covering, the anchoring device including a body having a rear surface, a holding member for holding an end of said guide element, and a receiving cavity for receiving the holding member, a first entrance to the receiving cavity in a first orientation to the rear surface and a second separate and distinct entrance to the receiving cavity in a second orientation to the rear surface that is non-coaxial with the first entrance, wherein the receiving cavity receives the holding member selectively either through one of the first entrance and the second entrance, the holding member cannot be pivoted between entrances, and wherein the second orientation is substantially different from the first orientation.

2. Anchoring device according to claim 1, wherein the body is adapted for attachment to a support structure of an architectural opening with the rear surface in contact with the support structure.

3. Anchoring device according to claim 1, wherein the first orientation is substantially perpendicular to the second orientation.

4. Anchoring device according to claim 1, wherein the first entrance includes a first opening and the second entrance includes a second opening, wherein the first opening is distinct from the second opening.

5. Anchoring device according to claim 1, wherein the first entrance includes a first bore section and the second entrance includes a second bore section.

6. Anchoring device according to claim 5, wherein the second bore section is oriented substantially different from the first bore section.

7. Anchoring device according to claim 6, wherein the second bore section is oriented substantially perpendicular to the first bore section.

8. Anchoring device according to claim 1, further provided with securing means for securing the elongate guide element to the holding member.

9. Anchoring device according to claim 8, wherein the securing means include a securing screw that can secure the elongate guide element.

10. Anchoring device according to claim 1, wherein the holding member can be inserted into the body of the anchoring device selectively in either of two different orientations thus establishing the first and second orientation of the rear surface with respect to the elongate guide element.

11. Anchoring device according to claim 1, further including a first locking member that is designed to be inserted into the body of the anchoring device, the first locking member preventing escape of the holding member from the body of the anchoring device as a result of tension exerted by the elongate guide element on the holding member.

12. Anchoring device according to claim 11, wherein a first locking member is inserted into the body of the anchoring device in an orientation substantially perpendicular to the orientation in which the holding member is inserted into the body of the anchoring device.

13. Anchoring device according to claim 11, wherein the locking member includes a first projection.

14. Anchoring device according to claim 1, wherein the holding member, when inserted into the body of the anchoring device and when there is tension in the elongate guide element, locks behind the body of the anchoring device.

15. Anchoring device according to claim 1, further including a third entrance.

16. Anchoring device according to claim 1, wherein the body includes a hole for receiving fastening means for attachment to a wall by the fastening means.

17. Method of mounting an anchoring device and an elongate guide element according to claim 1 to a support structure, the anchoring device including a body, the method including:

a) selecting a support structure and a surface of the support structure to which the body of the anchoring device will be attached, wherein the surface is either substantially parallel with the elongate guide element or is substantially perpendicular to the elongate guide element or makes an angle with the elongate guide element being substantially between 0 and 90 degrees, wherein the angle of the elongate guide element with respect to the surface is unimportant for the selecting; and b) attaching the body of the anchoring device to the support structure after a) has been carried out.

18. Anchoring device for anchoring an elongate guide element of an architectural covering, the anchor device including a body having a rear surface, a receiving cavity for receiving and holding the elongate guide element, a first entrance to the receiving cavity in a first orientation to the rear surface and a second entrance to the receiving cavity in a second orientation to the rear surface, wherein the receiving cavity receives the elongate guide element selectively either through one of the first entrance and the second entrance, and wherein the second orientation is substantially different from the first orientation, further provided with securing means for securing the elongate guide element inside the receiving cavity, wherein the securing means further includes a holding member, the holding member being separate from the body of the anchoring device, wherein the holding member holds the elongate guide element and wherein the holding member fits inside at least part of the receiving cavity, further including a first locking member that is designed to be inserted into the body of the anchoring device, the first locking member preventing escape of the holding member from the body of the anchoring device as a result of tension exerted by the elongate guide element on the holding member, the locking member including a first projection and wherein the holding member includes a second projection adjacent to the end of the holding member, which end is designed to first enter the body of the anchoring device, wherein the second projection locks behind the locking member when the holding member and the locking member are both inserted into the body.

19. Method of mounting an anchoring device and an elongate guide element according to claim 1 to a support structure, the anchoring device including a body, the method including:

a) selecting a support structure and a surface of the support structure to which the body of the anchoring device will be attached, wherein the surface is either substantially parallel with the elongate guide element or is substantially perpendicular to the elongate guide element or makes an angle with the elongate guide element being substantially between 0 and 90 degrees, wherein the angle of the elongate guide element with respect to the surface is unimportant for the selecting;

b) attaching the body of the anchoring device to the support structure after a) has been carried out, c) securing the elongate guide element inside a holding member, the holding member being included by the anchoring device, and d) inserting the holding member into the body thereby tensioning the elongate guide element, after a), b) and c) have been carried out, wherein the tension in the elongate guide element after insertion of the holding member is within predetermined boundaries.

20. Method according to claim 19, further including:

e) inserting a locking member into the device, after d) has been carried out.

21. Method of mounting an anchoring device and an elongate guide element according to claim 1 to a support structure, the anchoring device including a body, the method including:

a) selecting a support structure and a surface of the support structure to which the body of the anchoring device will be attached, wherein the surface is either substantially parallel with the elongate guide element or is substantially perpendicular to the elongate guide element or makes an angle with the elongate guide element being substantially between 0 and 90 degrees, wherein the angle of the elongate guide element with respect to the surface is unimportant for the selecting;

b) attaching the body of the anchoring device to the support structure after a) has been carried out, c) inserting the elongate guide element into the body and tensioning the elongate guide element, after b) has been carried out; and d) securing the elongate guide element inside the body, after c) has been carried out.

* * * * *